United States Patent [19]

Schleich et al.

[11] Patent Number: 4,571,913

[45] Date of Patent: Feb. 25, 1986

[54] PREFABRICATED FIREPROOF STEEL AND CONCRETE BEAM

[75] Inventors: Jean-Baptiste Schleich, Kockelscheuer; Erwin Lahoda, Dahlem; Jean-Paul Lickes, Kayl; Emile Reuter, Dudelange, all of Luxembourg

[73] Assignee: Arbed S.A., Luxembourg, Luxembourg

[21] Appl. No.: 603,509

[22] Filed: Apr. 24, 1984

[30] Foreign Application Priority Data

Apr. 25, 1983 [LU] Luxembourg ..... 84772

[51] Int. Cl.[4] ..... E04C 3/34

[52] U.S. Cl. ..... 52/722; 52/334; 52/340; 52/723; 52/727

[58] Field of Search ..... 52/722–729, 52/731, 732, 733, 334, 340, 730

[56] References Cited

U.S. PATENT DOCUMENTS

| | | | |
|---|---|---|---|
| 515,963 | 3/1894 | Krause | 52/727 |
| 3,050,161 | 8/1962 | Shlager | 52/722 |
| 3,593,477 | 7/1971 | Briggs | 52/723 X |
| 4,196,558 | 4/1980 | Jungbluth | 52/723 |
| 4,407,106 | 10/1983 | Beck | 52/722 |

FOREIGN PATENT DOCUMENTS

| | | | |
|---|---|---|---|
| 382117 | 1/1908 | France | 52/722 |
| 2061 | of 1860 | United Kingdom | 52/727 |

*Primary Examiner*—Donald G. Kelly
*Assistant Examiner*—Richard E. Chilcot, Jr.
*Attorney, Agent, or Firm*—Karl F. Ross; Herbert Dubno

[57] ABSTRACT

A composite structural element has a main steel beam having a web and at least two flanges extending therefrom, having oppositely directed outer faces, having outer edges generally defining a plane and defining with the web a recess open away from the web between the outer edges. A mass of concrete fills the recess substantially to the plane, the outer flange faces being exposed and substantially free of concrete. Another profiled steel beam is fixed to the web of the main beam and wholly imbedded in and covered by the concrete mass. Typically the main beam is an H- or I-beam and has two such channels provided with such other beams and filled with respective such masses. The other beams can be of T-section or each other beam can be an I- or H-beam. In addition it is possible to provide longitudinally extending steel reinforcing bars imbedded in the concrete mass. Steel fibers can also be imbedded as reinforcement in the concrete mass, and this mass can be at least partially of colloid concrete.

9 Claims, 4 Drawing Figures

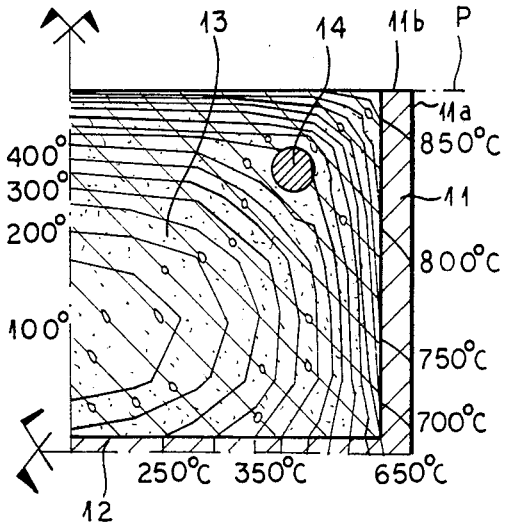
FIG. 1—PRIOR ART
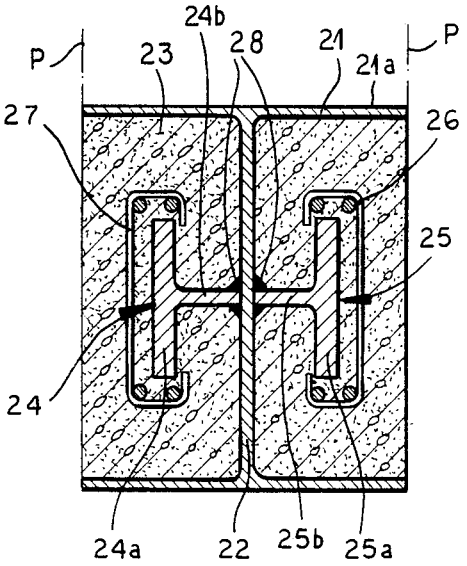
FIG. 2
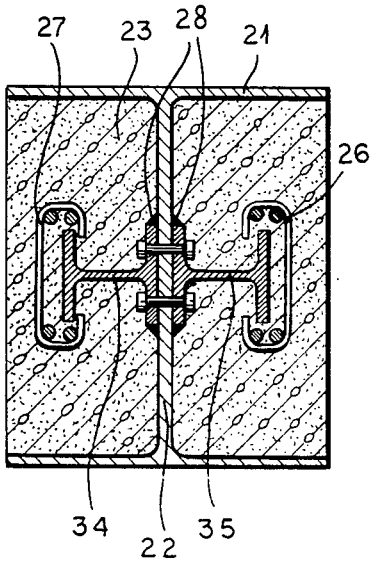
FIG. 3
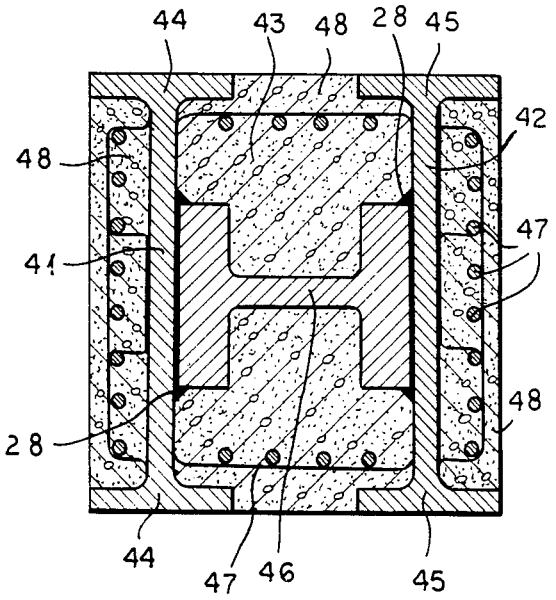
FIG. 4

PREFABRICATED FIREPROOF STEEL AND CONCRETE BEAM

FIELD OF THE INVENTION

The present invention relates to a composite beam or structural member. More particularly this invention concerns a steel beam which has been fireproofed with concrete and which is typically used as a post or column.

BACKGROUND OF THE INVENTION

It is standard to rate the static load the can be carried by a steel beam at ambient temperature, and to fireproof it in the field by spraying or otherwise cladding the installed steel with concrete, which also incidentally effectively shields the steel against corrosion. Such covering with concrete before installation is ruled out since it is essential to be able to bolt together faces of the steel of the beam for dimensional as well as structural accuracy. Precoating with concrete would make the structural elements impossible to dimension accurately, since the sprayed coating cannot be made as accurately as the steel beam itself unless done in a mold.

In recent times it has been suggested to make a fireproof structural element by filling a longitudinal channel of the beam in question with concrete and even stabilizing this concrete with reinforcing bars. Thus as described in German patent document No. 2,829,864 the channels of an I- or H-beam are completely filled with concrete, flush with the edges of the flanges, and while leaving the outer faces of these flanges fully exposed. In order to prevent differential thermal expansion from separating the concrete from the beam in a fire, it is standard to provide connectors welded to the beam web so that the concrete and beam are solidly locked together. This concrete, in which steel reinforcing bars are imbedded, does not project beyond the planes defined by the outer edges of the flanges, so the outline, that is the outer dimensions of the thus fireproofed beam, remains that of the basic I- or H-beam, greatly easing subsequent installation.

In a fire the exposed beam flanges are heated first, so that although under normal circumstances they bear most of the load, they weaken and the load is transferred to the reinforced-concrete portion of the composite element. In addition in a fire the steel reinforcement of the concrete is normally positioned so thast it also is heated and softens rather rapidly. Thus it is necessary to make the composite beam relatively massive and correspondingly expensive to obtain the desired fire rating.

Another disadvantage of the known such composite beam is that its fabrication is fairly complex,, too much to do in the field. Thus the heavy beams must be transported to the job from a remote shop.

OBJECTS OF THE INVENTION

It is therefore an object of the present invention to provide an improved steel-and-concrete composite beam.

Another object is the provision of such a steel-and-concrete compoite beam which overcomes the above-given disadvantages, that is which can be prefabricated at low cost, yet which will experience little loss in strength over a long time in a fire.

SUMMARY OF THE INVENTION

A composite structural element according to the invention has a main steel beam having a web and at least two flanges extending therefrom, having oppositely directed outer faces, having outer edges generally defining a plane and defining with the web a recess open away from the web between the outer edges. A mass of concrete fills the recess substantially to the plane, the outer flange faces being exposed and substantially free of concrete. Another profiled steel beam is fixed to the web of the main beam and is wholly imbedded in and covered by the concrete mass. Typically according to this invention the main beam is an H- or I-beam and has two such channels provided with such other beams and filled with respective such masses.

Thus the system of the present invention can be made of standard rolled steel profile beams and can be fabricated relatively easily, even right in the field. The wholly imbedded steel profife beam is, however, able to remain cool and strong for a long time, as the transmission of heat to it in a fire is either through the concrete surrounding it or through the weld or bolt connecting it to the web of the main beam. Neither the concrete nor the welds will conduct heat well, and the web of the main beam itself is normally wholly imbedded, so it can only get hot by transmission from the exposed flanges.

The beam according to this invention is particularly useful in quake-proof construction. the different resonant frequencies of steel and concrete, as well as the different types of deformation and so on make the composite beam itself nonresonant. Vibrations cannot build up in the structure of this invention and lead to structural failure; instead they will be effectively damped at virtually every level.

According to another feature of this invention the other beams can be of T-section. Each other beam can equally be an I-or H-beam. In addition it is possible according to this invention to provide longitudinally extending steel reinforcing bars imbedded in the concrete mass. Steel fibers can also be imbedded as reinforcement in the concrete mass, and this mass can be at least partially of colloid concrete.

DESCRIPTION OF THE DRAWING

The above and other features and advantages will become more readily apparent from the following, it being understood that any feature described with reference to only one embodiment of the invention can be used where possible with any other embodiment. In the accompanying drawing:

FIG. 1 is a cross section through a detail of a prior-art composite beam;

FIG. 2 is a crossf section through a composite beam according to the present invention; and FIGS. 3 and are sections like FIG. 2 through further beams in accordance with the invention.

SPECIFIC DESCRIPTION

AS seen in FIG. 1 a prior-art composite beam, only a quarter of which is shown, has an I- or H-beam core 11, 12 having a web 12 and a pair of flanges 11 whose outer faces 11*a* are exposed and whose outer edges 11*b* define planes P. A concrete mass 13 in which are imbedded reinforcement rods 14 completely fills the parallepipedal channel defined between the two flanges 11 on two opposite sides and the plane P and web 12 and plane P on the other two opposite sides.

The lines connecting point of like temperature (in °C.) in FIG. 1 illustrate the temperatures in the prior-art composite beam after being exposed to a standard fire for 60 min. The placement of the steel 14 is therefore such that it will be very hot, more than 600° C., after a one-hour fire, and therefore will have lost much of its strength. As a result such a structural element must be very massively built to maintain sufficient strength in a fire.

According to this invention an I- or H-beam 21, 22, has a central web 22 and a pair of flanges 21, the latter having outer faces 21*a* and edges 21*b* . Masses 23 of concrete fill the two channels defined within the planes P defined by the outer edges 21*b*. In addition each of these masses 23 wholly encases a respective T-section beam 24 or 25 having an arm-defining flanges 24*a* or 25*a* and a central leg 24*b* or 25*b*. Welds 28 secure the edge of the leg 25*b* to the center of the web 22 of the beam 21, 22. C-section reinforcement wires 26 and 27 surround the arms of the beams 24 and 25 and serve mainly from preventing the concrete from separating from the steel in a fire.

In such an arrangement the well imbedded steel beams 24 and 25 will remain relatively cool so that the considerable strength of these beams 24 and 25 will be retained. The welds 28 buried in the concrete 23 will not transmit much heat from the beam 21, 22 to the beams 24 and 25, further increasing the time the steel beams 24 and 25 remain strong.

Such a composite beam can be made relatively easily right on the job. After welding in the T-beams 24 and 25 and fabricating the meshes 26 and 27, the steel is laid down with one of the channels open upward, that is with the planes P vertical. The ends of the steel are blocked with plywood or the like, and concrete is simply poured into the upwardly open channel. The concrete is vibrated to make good contact, and is leveled simply by pulling a screed along the edges 21*b*. Once the upper mass 23 is cured, the beam is turned over and the other side is done in the same manner.

In FIG. 3 the arrangement is identical to that of FIG. 1, except that small H-beams 34 and 35 replace the T-beams 24 and 25. Such construction makes doing the welds 28 much easier and eliminates the need of clamps during welding. The strength of the finished beam about its weak axis is also substantially increased. This figure also shows bolts 36 that can be used instead of or in addition to the welds 28.

The arrangement of FIG. 4 has two I-beams 41 and 42 extending parallel to each other and having respective flanges 44 and 45 defining the outer surfaces of the finished structure. These beams are joined by another H-beam 46 having flanges welded at 28 to the webs of the beams 41 and 42. All the space within the planes of the flanges 44 and 45 is filled with concrete, in three separate masses. In addition the concrete masses 48 here are of colloid concrete reinforced with fibers, and wire/rod reinforcement 47 is provided in this concrete 48. In fact with appropriate selection of colloid and steel-fiber reinforcement, it is possible to wholly eliminate the reinforcement 47, or similarly eliminate it in any of the other embodiments.

We claim:

1. A composite structural element comprising:

a longitudinally extending main steel beam having a web and at least two flanges extending therefrom, having oppositely directed outer faces, having outer edges generally defining a plane, and defining with the web a longitudinally extending recess open away from the web between the outer edges;

a longitudinally extending mass of concrete filling the reces substantially to the plane, the outer flange faces being exposed and substantially free of concrete; and another profiled steel beam fixed to the web of the main beam, extending longitudinally generally the full length of the main beam, and wholly imbedded in and covered by the concrete mass.

2. The composite steel/concrete structural element defined in claim 1 wherein the main beam is an I-beam and has two such channels provided with respective such other beams and filled with respective such masses.

3. The composite steel/concrete structural element defined in claim 1 wherein the main beam is an H-beam and has two such channels provided with respective such other beams and filled with respective such masses.

4. The composite steel/concrete structural element defined in claim 1 wherein the other beam is of T-section.

5. The composite steel/concrete structural element defined in claim 1, further comprising longitudinally extending steel reinforcing bars imbedded in the concrete mass.

6. The composite steel/concrete structural element defined in claim 1, further comprising steel fibers imbedded in the concrete mass.

7. The composite steel/concrete structural element defined in claim 1 wherein the concrete mass is at least partially of colloid concrete.

8. The composite steel/concrete structural element defined in claim 1, further comprising welds securing the beams together.

9. The composite steel/concrete structural element defined in claim 1, further comprising bolts securing the beams together.

* * * * *